US006748605B1

(12) United States Patent
Brinkmann

(10) Patent No.: US 6,748,605 B1
(45) Date of Patent: Jun. 15, 2004

(54) GLOVE

(75) Inventor: Fritz Brinkmann, Rettenbach (DE)

(73) Assignee: Nordenia Deutschland Pacimex GmbH, Scheyern (DE)

( * ) Notice: Subject to any disclaimer, the term of this patent is extended or adjusted under 35 U.S.C. 154(b) by 145 days.

(21) Appl. No.: 09/959,901

(22) PCT Filed: Mar. 15, 2001

(86) PCT No.: PCT/EP01/02990

§ 371 (c)(1),
(2), (4) Date: Feb. 19, 2002

(87) PCT Pub. No.: WO01/67904

PCT Pub. Date: Sep. 20, 2001

(30) Foreign Application Priority Data

Mar. 16, 2000 (DE) ..... 200 04 858 U
Mar. 16, 2000 (DE) ..... 200 04 857 U
Aug. 17, 2000 (DE) ..... 100 40 210

(51) Int. Cl.[7] ..... A41D 19/00

(52) U.S. Cl. ..... 2/161.6; 2/159; 2/167; 2/169

(58) Field of Search ..... 2/158, 159, 161.6, 2/16, 161.7, 167, 169; 15/227; 206/390, 278

(56) References Cited

U.S. PATENT DOCUMENTS 2,840,823 A * 7/1958 Kita ..... 2/158
3,384,083 A * 5/1968 Cozza et al. ..... 2/167
3,638,789 A * 2/1972 Tuszewski ..... 15/227
3,805,297 A * 4/1974 Margolis ..... 2/158
3,920,500 A * 11/1975 Brieske ..... 2/169
4,065,826 A * 1/1978 Hough ..... 15/227
4,916,757 A * 4/1990 Berlin et al. ..... 2/159
4,928,322 A * 5/1990 Bradfield ..... 2/169
5,025,503 A * 6/1991 O'Brien ..... 2/163
5,966,741 A * 10/1999 Klecina ..... 2/169
6,168,019 B1 * 1/2001 Olson ..... 206/390
2002/0178482 A1 * 12/2002 Samuelsson et al. ..... 2/16

FOREIGN PATENT DOCUMENTS

FR 2542980 A1 * 9/1984 ..... A41D/19/00
GB 2114871 A * 9/1983 ..... A41D/19/00
JP 06108301 A * 4/1994 ..... A41D/19/00
WO WO 9103954 A1 * 4/1991 ..... A41D/13/08
WO WO 9501736 A1 * 1/1995 ..... A41D/19/00

* cited by examiner

*Primary Examiner*—Rodney M. Lindsey
(74) *Attorney, Agent, or Firm*—Antonelli, Terry, Stout & Kraus, LLP

(57) ABSTRACT

The present invention relates to a glove, especially a single-use or disposable glove with at least two essentially congruent plastic sheets, one forming the outer face for the back of the hand and one forming the inner face for the palm of the hand and with at least one absorbent outer layer applied to the outer face and/or top side of the inner face, which outer layer is provided with at least one fluid, especially sprayed and/or soaked and/or impregnated, the plastic sheets being permanently joined to one another at least along the lateral border regions while providing a glove opening which is opposite the finger section, is essentially sealed against the penetration of fluid, and may be exposed and/or opened when the glove is to be used.

42 Claims, 5 Drawing Sheets

GLOVE

This invention relates to gloves, especially single-use or disposable gloves, with at least two essentially congruent plastic sheets, one forming the outer face for the back of the hand and one forming the inner face for the palm of the hand and with at least one absorbent outer layer applied to the outer face and/or top side of the inner face, which outer layer is provided with at least one fluid, especially sprayed and/or soaked and/or impregnated.

The term "glove" here is intended to encompass both gloves and mitts. Such single-use or disposable gloves are composed essentially of plastic and are employed, for example, for cleaning purposes of all types, for example, personal hygiene and washing infirm or bedridden persons.

To facilitate the work of the person performing the cleaning or washing, the absorbent outer layer, usually the top layer applied to the inner face, is already provided with at least one fluid—for example, either a cleaning or washing fluid—that is, for example, sprayed and/or soaked and/or impregnated.

Since these gloves are—especially by reason of their consistency—in the form of single-use or disposable items, they are often provided in multi-packs, for example, ten-packs; to save space, packaging material and storage space, a lesser or greater number of these gloves are proved in a folded, rolled and/or stacked state.

There exists a risk here that the fluid with which the outer layer of the gloves is provided will over time penetrate the opening of the glove—an undesirable result, particularly for health reasons.

In view of the above disadvantages and inadequacies, the object of the present invention is to further develop such gloves, especially such single-use or disposable gloves, in a simple and inexpensively producible manner so as to always prevent any penetration of the fluid with which the outer layer is provided into the interior of the glove.

This objective is achieved by a glove of the type referred to at the outset in which, according to the teaching of the present invention, the plastic sheets are essentially permanently joined to one another, at least along the lateral border regions, while providing a glove opening which, opposite the finger section, is essentially sealed against the penetration of fluid, and may be exposed and/or opened when the glove is to be used.

A glove is thus created according to the invention which is provided on its outer face, preferably however only on the top of its inner face, with a suitably "superabsorbent" outer layer of paper or (paper) nonwoven material. This paper layer or nonwoven layer may be kept very thin, thereby saving a considerable amount of material.

Since the absorbent outer layer usually applied to the top of the inner face is provided with at least one fluid—for example, a cleaning or washing fluid—which has been sprayed and/or soaked and/or impregnated, the opening of the glove is essentially sealed against the penetration of fluid and may be exposed and/or opened when the glove is to be used.

As a result, a glove, especially a single-use or disposable glove, is created in a manner surprising to an individual skilled in the art, which glove may be produced both simply and inexpensively, and the design of which reliably prevents any fluid contained in the outer layer of the gloves from penetrating the interior of the glove over time.

In a preferred further embodiment of the present invention, at least one strip is located along the opening of the glove or arranged in the area of the glove opening extending essentially perpendicularly to the direction in which the hand is inserted, specifically one attached along the edge of the inner face opposite the finger section (the term "finger section" being understood to comprise the area including the thumb and four remaining fingers—index finger, middle finger, ring finger, little finger).

This strip which advantageously extends across essentially the entire width of the glove and which, for example, may be essentially either opaque or transparent, serves, among other functions, to affix the plastic sheet containing the outer face—either along the opening of the glove or to the plastic sheet containing the inner face in the area of the glove opening so as to ensure a durable, and especially a fluid-tight seal for the opening of the glove.

In an especially innovative further embodiment of the present glove, the plastic sheets are permanently attached to one another as well in the border regions of the opening of the glove, for example, by adhesion and/or by welding or sealing.

In one preferred embodiment, to permit access to the interior of the glove when the glove is to be used, along the glove opening or in the area of the glove opening there is provided at least one score line or tear line in the plastic sheet containing the outer face, which line extends essentially in a direction perpendicular to the hand-insertion direction and is appropriately created before the adhesive-based and/or welded and/or sealed joining of: the plastic sheet containing the outer face, the plastic sheet containing the inner face and the outer layer, which line is closer to the finger section than is the permanent and essentially fluid-impermeable joint of the plastic sheets located in the border regions of the glove opening, and along which line the glove opening is designed to be opened. Thus by opening this score line or tear line, the hand may be inserted in the direction of insertion into the interior of the glove.

In another particularly advantageous embodiment of the present invention, along the glove opening or in the area of the glove opening, there may be provided at least one score line or tear line, extending essentially perpendicularly to the hand-insertion direction, in the plastic sheet containing the outer face, in the plastic sheet containing the inner face and in the outer layer, which line is closer to the finger section than the essentially fluid-impermeable joint of the plastic sheets located permanently in the border regions of the glove opening, and which line is designed to be opened along the opening of the glove.

Because of this essentially "penetrating" score line or tear line, that is one comprising all layers (=both plastic sheets and outer layer) of the glove, when the glove is to be used, access to the glove opening may be readily accomplished by detaching the section of the glove adjacent to the glove opening along the score line or tear line.

The score lines or tear lines presented above may extend practically across the entire width of the glove so as to facilitate complete access to the interior of the glove. To simplify the manipulation of the score lines or tear lines, it is recommended these be essentially linear in shape.

If there is a need to further develop the present invention in an especially innovative way, it is advisable to design the score line or tear line as a sealed region or sealed line. As an alternative or supplemental approach, the score line or tear line may also be designed as a specially hard-pressed region or specially hard-pressed line. The score line or tear line may also be achieved using knurling equipment (→knurled region or knurled line); and finally, another conceivable approach is to create the score line or tear line by at least one perforation process.

According to another especially innovative further embodiment of this glove, the edge of the outer face opposite the finger section may be offset from edge of the inner face opposite the finger section. This approach facilitates the especially comfortable insertion of the hand into the glove since the user of the glove may as necessary compensate for the fact that the two plastic sheets may adhere to one another by simply grasping the overlapping edge and easily pulling the two plastic sheets apart.

Unrelated to the above, or in conjunction with the above, one advantageous embodiment of the present invention locates at least one optionally reclosable closure along the glove opening or in the region of the glove opening, which closure specifically has the function of exposing and/or opening the glove opening, in practice extends essentially in a direction perpendicular to the hand-insertion direction, and specifically extends essentially across the entire width of the glove opening.

The closure is advantageously composed of plastic—as are the plastic sheets—for example, in the form of a so-called "mini-grip" system in which the closure has on the inner face of the one plastic sheet at least one strip, and on the inner face of the other plastic sheet at least one grooved receiving means for the strip.

As an alternative or supplemental approach to the above, the closure may also be optionally designed as at least one adhesive tape and/or as at least one adhesive label and/or at least one adhesive flap and/or at least one tape.

In an optional embodiment of the present invention, the closure is burr-like, that is, has a Velcro-type design, thus permitting reclosability of the glove since a closure based on the principle of a Velcro-type closure may be opened and closed repeatedly, with the result that this type of closure is easily capable of undergoing repeated use.

This capability also applies to a closure based on at least one "mini-grip" system, as well as to a closure based on at least one adhesive tape and/or at least one adhesive label and/or at least one adhesive flap and/or at least one tape.

According to an especially advantageous further embodiment of the present invention, at least one adhesion agent may be provided extending in a direction essentially perpendicular to the hand-insertion direction in the region of the glove opening between the plastic sheet containing the outer face and the plastic sheet containing the inner face, which adhesion agent extends practically across the entire width of the glove and also functions in effect as a closure.

Recommended adhesion agents in this regard are specifically:

- at least one cold-setting adhesive or cold-setting glue and/or
- at least one thermosetting adhesive (so-called hot-melt-adhesive)

In another advantageous further embodiment of the present invention, the absorbent outer layer provided with at least one fluid, namely for example sprayed and/or soaked and/or impregnated, is statically chargeable, specifically electrostatically chargeable and/or magnetostatically chargeable—thus advantageously also rendering the glove suitable for wiping away dirt and/or dust, since due to the use of an outer layer material with high static chargeability the dirt and/or dust readily accumulates on the outer layer. This is achieved in an especially efficient manner by providing the outer layer with iron filings in powder form.

In order, for example, to reliably prevent the accumulation of pathogenic germs or the like when the present invention is used as a cosmetic glove and/or as a medical glove, the outer layer includes, in a preferred embodiment of the present invention, at least one disinfecting and/or germicidal additive, for example, in the form of a disinfectant which may be applied to the outer layer as an additive.

A significant advantage in this regard is the fact such disinfecting and/or germicidal additives may be very precisely dosed, one possible example of these to be considered being ground spices incorporated into the (paper) nonwoven material.

A useful approach is to have the absorbent outer layer include paper or a nonwoven material, as already mentioned, and to have the plastic sheet be weldable and/or sealable; the plastic sheet consists preferably of polyethylene (PE), which material provides the advantage that it may under certain circumstances be permeable to air while remaining impermeable to liquids; by contrast, polypropylene (PP) may, if certain requirements are met, be permeable to liquid but not, however, permeable to air.

According to an advantageous further embodiment of the present invention, at least one of the plastic sheets is microperforated, at least in certain regions. This thus creates a glove which is more or less breathable since the plastic sheets permit the exchange of air while not permitting any exchange of fluid; the positive result is that any possible uncomfortable sweating of the hand in the glove is precluded.

From the top view, the essentially congruent plastic sheets may be preferably of rectangular design. The plastic sheets are formed in a simple manner from a plastic web in the shape of a tube extending in a longitudinal direction, the folding edge extending in a longitudinal direction forming the top face of the glove in the region of the fingertips of the inserted hand and the two edges opposite the folding edge forming the glove opening; the gloves thus lie adjacent to one another in a transverse orientation.

The result is that there is no requirement of providing a welding seam or sealing seam in the area of the folding edge, thus simplifying production of the glove. Only along the lateral border regions, and optionally in the border regions of the glove opening, are the congruent plastic sheets appropriately permanently joined, in an essentially fluid-impermeable manner, by adhesive bonding and/or by welding and/or by sealing. However, the gloves may be formed from the plastic web while advantageously rotated at right angles, that is, oriented sequentially.

In another advantageous design replacing the essentially rectangular interior or essentially round or at least rounded interior for the hand, at least a partial region has a welded seam or sealed seam running a certain distance from the lateral border regions and/or from the folding edge to form an actual glove (with up to six receiving regions for the fingers, but also receiving regions which may accommodate two or more fingers simultaneously) or to form a mitt; this design makes the glove both more useful with a better grip and easier to manipulate.

The welded seam or sealed seam as seen from the top view may advantageously incorporate on both sides of the finger section a thumb section to accommodate the thumb. In this approach there is no need to separately produce gloves for the left hand and gloves for the right hand; rather, each glove may be worn on either the right or left hand such that the outer layer is matched to the inner face of the glove.

Another advantageous embodiment of the present invention involves adding, to the two congruent plastic sheets, at least one additional congruent plastic sheet on the side opposite the outer layer, this additional plastic sheet being joined at least to the adjacent plastic sheet by another welded or sealed seam which runs a certain distance from the welded seam or sealed seam forming a glove or forming a mitt, but essentially parallel to these.

The additional welded or sealed seam here should occupy a larger area than the first welded seam or sealed seam such that one glove each is formed between each of the two adjacent congruent plastic sheets, but of differing size. This ensures that the gloves may be used either for very large hands or very small hands without impairing comfort.

Two or more single-use or disposable gloves are preferably provided in a direction longitudinal to the plastic web, either adjacent or sequentially depending on their orientation on the plastic web, the individual gloves being easily separable along at least one straight-line perforation running perpendicularly to the longitudinal direction. By this approach, the gloves may be rolled up according to the invention in the longitudinal direction and may be individually dispensed by a dispenser.

To further develop the glove according to the present invention in an especially advantageous way, it is recommended that at least one locking closure with at least one fixation strip or closing strip extending essentially perpendicularly to the hand-insertion direction be provided. In a preferred approach, at least on fixation or closing strip is thus formed which is located in the region of the so-called "cuff" of the glove and by which the glove opening may be closed after the hand is inserted into the glove.

The location of the locking closure in the region of the glove opening, that is in the cuff section, has two advantages, first: there is no requirement of any additional material since the required material is already provided by the plastic sheet(s) and would otherwise become scrap, and secondly: providing the locking closure and concomitant closing function in the region of the glove opening reliably prevents the hand from sliding out of the glove since the cuff section, that is a section of the glove opening, which would otherwise tend to exhibit uncontrolled flapping, and under extreme conditions undesirable tearing, is fixable and closable by the locking closure.

In one specialized embodiment, the fixation or closing strip has two ends, in which preferably the one end is provided on the one side, and the other end is provided on the other side of the glove opening. An especially effective closing function in regard to the glove opening is achieved here if the one end is foldable against the other end and the ends are detachably fastenable to one another.

In this regard, it is advisable to design the one end as at least one receiving component having a clear opening section, and the other end as an insertion component adapted to the opening region and intended for insertion into the opening section. Advantageously, the insertion component is then foldable against the receiving component and detachably fastenable to the receiving component since the insertion component may be inserted into the receiving component containing the opening section such that it is detachably fastened to the receiving component.

The above-outlined locking and fixing principle then functions, for example, preferably for the region of the glove opening to be closed if the receiving component is provided on the one side of the glove opening and the insertion component is provided on the other side of the glove opening. This configuration reliably ensures that the insertion component is foldable against the receiving component and is detachably fastenable to the receiving component.

As an alternative or supplement to the above, the fixation or closing strip may be knottable and/or tieable and/or detachably fastenable by means of at least one adhesive spot or at least one adhesive strip or at least one tape.

According to one especially innovative further embodiment of the present invention, the outer face is provided with at least one support strip. This support strip has first of all a stabilizing function, specifically when the gloves are according to the present invention are unrolled in a longitudinal direction and individually dispensed by a dispenser; secondly, the support strip may be used as a holding device for the glove, specifically when the support strip is provided in a material-saving approach in place of the plastic sheet forming the outer face.

In the latter case, the hand of the user is inserted between support strip and the plastic sheet forming the inner face, that is, the support strip functions, as it were, as a holding strap or holding device which is pulled over the back of the hand. In connection with this approach, an especially advantageous function is ensured if two roughly parallel support strips are provided.

In one especially innovative further embodiment of the present glove, the closure and the locking closure are designed to be uniform and/or of one piece and/or of integrated form, thereby saving additional material since the material required both for the closure and for the locking closure is already provided by the plastic sheet(s) and would otherwise only become scrap.

Additional embodiments, features and advantages of the present invention will be described below based on the drawings shown in FIGS. 1 through 11 in which examples of the six embodiments of the present gloves are illustrated.

The same or similar components or features of the present invention are shown in FIGS. 1 through 11 with identical reference numbers.

Figure 1:
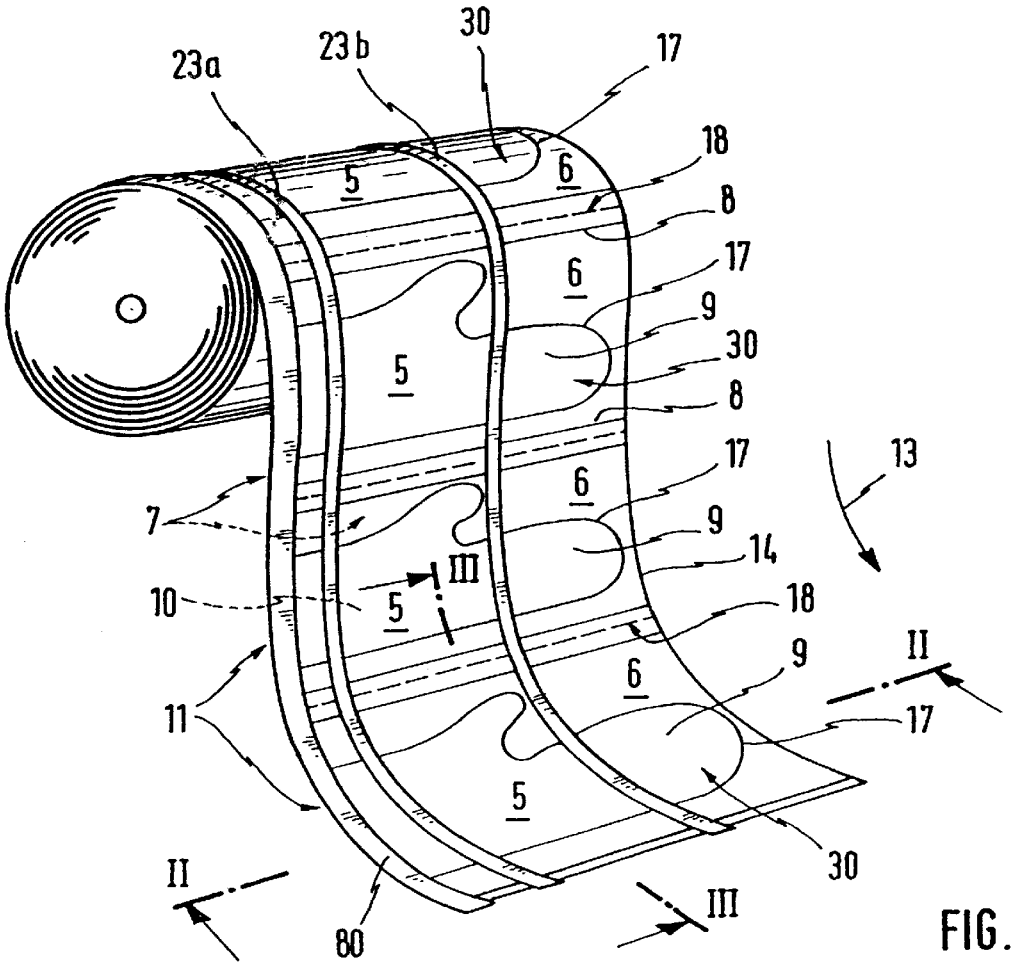
FIG. 1 shows in a perspective, schematic view, a plurality of single-use or disposable gloves arranged in the longitudinal direction transversely adjacent to each other in accordance with a first embodiment.

In FIG. 1, reference 5 identifies single-use or disposable gloves according to a first embodiment of the present invention. The gloves have two congruent plastic sheets 6, 7, rectangular as viewed from the top, which are permanently joined by adhesive bonding or welding in the border regions 8, and forming an outer face 9 and an inner face 10 while exposing a glove opening 11.

Additionally, glove 5 is provided on the top of inner face 10 with an absorbent outer layer 12 consisting of a paper (nonwoven material). This outer layer 12 is provided—as is outer layer 12 of the following embodiments of the present glove 5 or 50—with a fluid, specifically a cleaning or washing fluid, that is, sprayed and/or soaked and/or impregnated.

By comparison, plastic sheets 6, 7 consist of microperforated polyethylene (PE), thereby providing an essentially breathable glove 5 which permits the exchange of air; this has the positive effect that any uncomfortable sweating of the hand in the glove may be precluded.

The congruent plastic sheets 6, 7 are formed from a folded plastic web in the shape of a tube extending in the longitudinal direction 13, where folding edge 14 extends in longitudinal direction 13 forming the top face of glove 5 in the region of the fingertips, and the two edges 15, 16 opposite folding edge 14 form glove opening 11.

Figure 2:
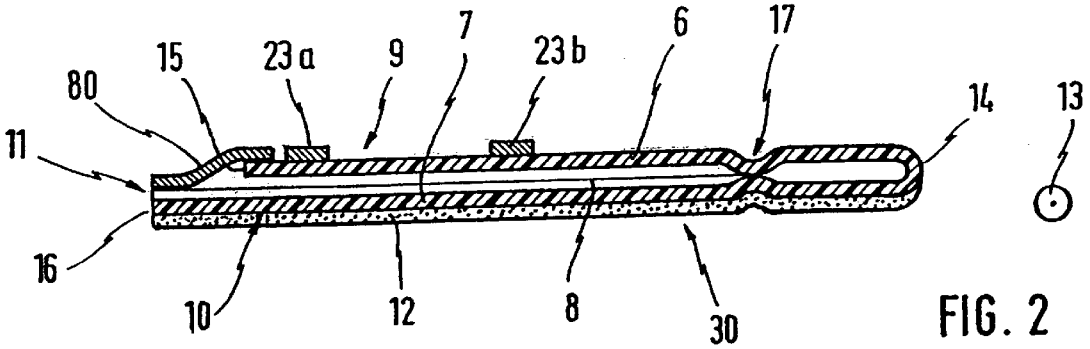
FIG. 2 shows a view along line II—II in FIG. 1.

As may be seen in FIG. 2 (=view along line II—II of FIG. 1), edge 15 of outer face 9 opposite the finger section 30 is offset from edge 16 of inner face 10 opposite finger section 30.

This design ensures the especially comfortable insertion of the hand into glove 5 since the user of the glove may as necessary compensate for the fact that the two plastic sheets 6, 7 may adhere to one another by simply grasping the overlapping edge and easily pulling the two plastic sheets apart.

In order to prevent the fluid with which outer layer 12 of glove 5 is provided from penetrating over time through glove opening 11 into the interior of the glove before the glove is used, there is located along glove opening 11 a closure 80 in the form of an adhesive tape which is removable to expose and open glove opening 11 and which extends essentially in a direction perpendicular to the hand-insertion direction, and thus across the entire width of glove opening 11 (see FIGS. 1 and 2).

Figure 3:
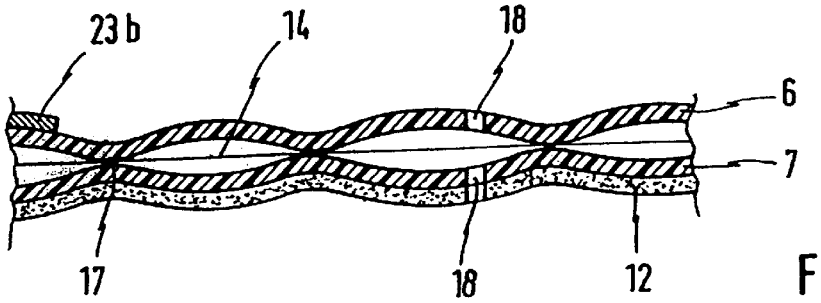
FIG. 3 shows a view along line III—III in FIG. 1.

The congruent plastic sheets 6, 7 joined along the lateral border regions 8 by welding or sealing additionally have in certain sections a sealing seam 17 running at a certain distance from border regions 8 and/or from folding edge 14—in the first embodiment shown in FIGS. 1 through 3 in the form of a mitt.

As FIG. 1 shows, a plurality of single-use or disposable gloves 5 is provided adjacent to each other in longitudinal direction 13 of the plastic web, which gloves are each easily separable yet joined together by a linear perforation 18 running essentially at right angles to longitudinal direction 13.

As FIGS. 1 through 3 also show, two parallel support strips 23*a* and 23*b* are provided on outer face 9 of glove 5. These support strips 23*a*, 23*b* have first of all a stabilizing function, specifically when gloves 5 are according to the present invention to be unrolled in longitudinal direction 13 (see FIGS. 1 and 2) and are individually dispensed by a dispenser; secondly, support strips 23*a*, 23*b* may be used as a holding device for glove 5, specifically in an approach fundamental to the invention whereby support strip 23 or support strips 23*a*, 23*b* are provided in place of plastic sheet 6 forming outer face 9.

In the latter case, the hand of the user is inserted between support strips 23*a*, 23*b* and plastic sheet 7 forming inner face 10, that is, the support strips 23*a*, 23*b* function as a holding strap or holding device which is pulled over the back of the hand.

In a second alternative embodiment different from those in FIGS. 1 through 3, the gloves 50 are arranged in longitudinal direction 13 sequentially adjacent to each other—in contrast to the first embodiment in which the gloves 5 are arranged transversely adjacent to each other. Here the top side of glove 50 adjacent to the fingertips is provided with a sealing seam 8 running perpendicularly to longitudinal direction 13. Provided in parallel to this sealing seam 8 but on the side facing away from the top face of glove 50 is linear perforation 18 which, when separated, forms glove opening 11.

Figure 4:
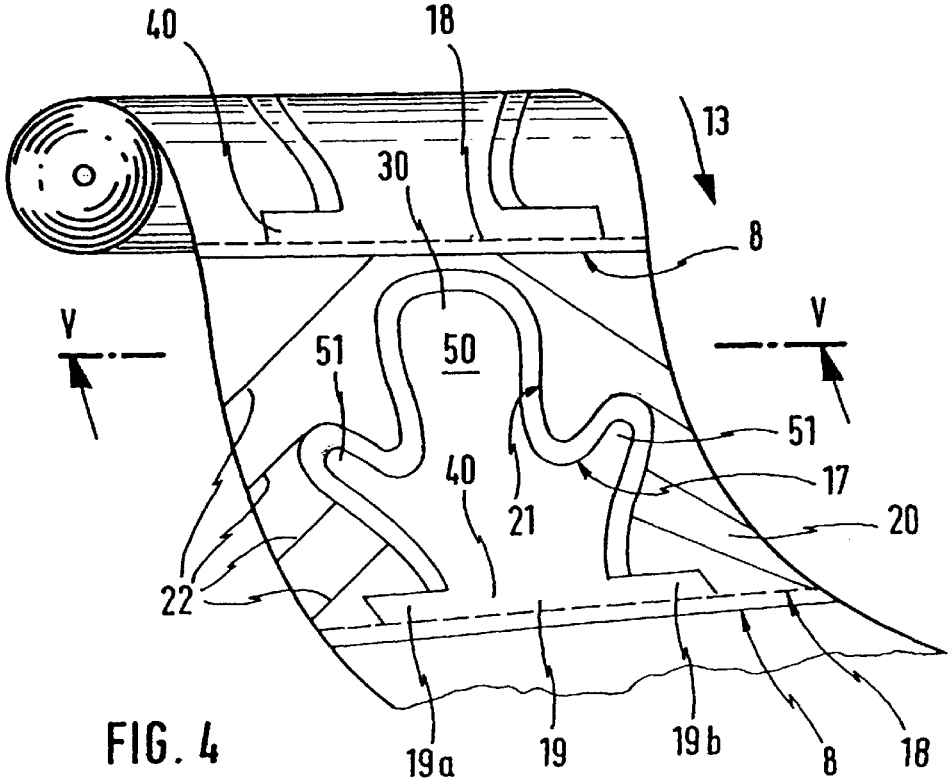
FIG. 4 shows in a perspective, schematic view, a plurality of single-use or disposable gloves arranged in the longitudinal direction sequentially adjacent to each other in accordance with a second embodiment.

As FIG. 4 shows, sealing seam 17 of glove 50 delineates, as seen from the top view, along both sides of finger section 30 (defined by the little finger, ring finger, middle finger and index finger) one thumb section 51 each to accommodate one thumb, and thus forms, as it were, a mirror image of glove 50 in longitudinal direction 13.

As shown in FIG. 4, a strip 40 extends in a direction perpendicular to the hand-insertion direction in the region of glove opening 11. This strip 40, which extends across almost the entire width of glove 50 and is opaque, serves to affix plastic sheet 6 to plastic sheet 7 in the region of glove opening 11 so as to ensure, until the glove is used, a durable and especially a fluid-impermeable closure to for glove opening 11, thereby ensuring that the fluid impregnated in outer layer 12 of glove 50 does not penetrate the interior of glove 50 through glove opening 11 when gloves 50 are stored in a rolled-up state.

FIG. 4 additionally shows that a locking closure is provided with a fixation or closing strip 19 extending perpendicularly to the hand-insertion direction in the region of glove opening 11. This fixation or closing strip 19 is integrated with strip 40, that is, is designed as a single-piece or in integrated form (see FIG. 4), thereby providing an additional savings in material since the material required both for the strip 40 and for fixation or closing strip 19 is already provided by plastic sheet 7 and would otherwise only become scrap.

Fixation or closing strip 19 has two ends 19*a*, 19*b*, one end 19*a* being provided on the left side, in FIG. 4, of glove opening 11, and the other end 19*b* being provided on the right side, in FIG. 4, of glove opening 11.

The inclusion of this fixation and closing strip 19, which is located in the region of the so-called "cuff" of glove 50 and by which glove opening 11 is closable after the hand is inserted into glove 50, has two advantages, first: there is no requirement of any additional material since the material required for fixation or closing strip 19 is already provided by plastic sheet 6 or 7, and would otherwise only become scrap; secondly: providing the fixation or closing strip 19 and concomitant closing function in the region of glove opening 11 prevents the hand from sliding out of the glove since the cuff section, that is a section of glove opening 11, which would otherwise tend to exhibit uncontrolled flapping, and under extreme conditions undesirable tearing, is fixable and closable by means of the fixation or closing strip 19.

In the special design shown in FIG. 4, the one end 19*a* is provided on the left side, in FIG. 4, of glove opening 11 and the other end 19*b* is provided on the right side, in FIG. 4, of glove opening 11.

An especially effective closing function for glove opening 11 is achieved here based on the fact that the one end 19*a* is foldable against the other end 19*b*, and by the fact that the two ends 19*a*, 19*b* are detachably fastenable to each other by means of two adhesive strips which have previously been protected against contamination by siliconized coverings.

Figure 5:
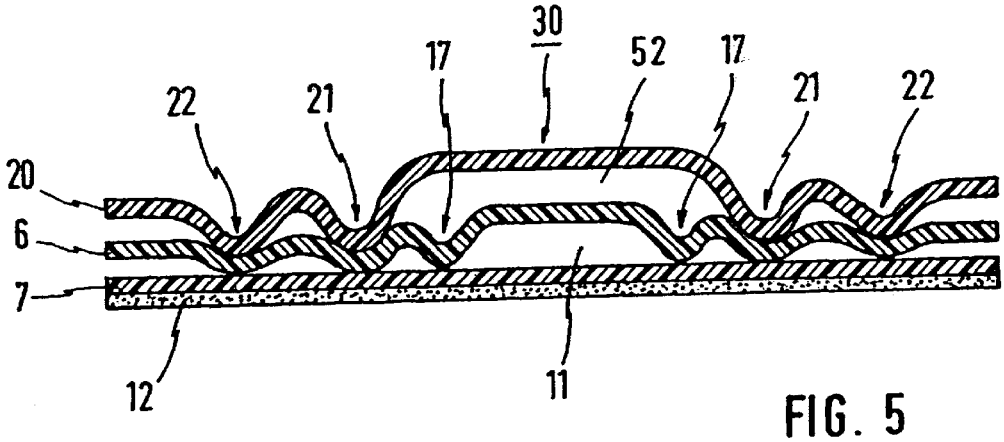
FIG. 5 shows a view along line V—V in FIG. 4.

In addition, FIG. 5 shows in a cross-sectional view that an additional congruent plastic sheet 20 with an additional sealing seam 21 encompassing a greater area than sealing seam 17 but running at a certain distance roughly parallel to the latter has been applied to the two congruent plastic sheets 6, 7 on the face of glove 50 opposite electrostatically chargeable outer layer 12 provided with a disinfectant additive. The result of the above is an additional glove produced in one work step with a glove opening 52, this glove being of a larger design than the glove formed from the two congruent plastic sheets 6, 7.

In order to provide glove 50 with a better dimensionally stable design, stabilization joints 22 have been provided outside the region of sealing seam 17 (see the first embodiment of FIGS. 1 through 3) or outside the second sealing seam 21 (see the second embodiment of FIGS. 4 and 5), which joints are designed as sealing seams in the second embodiment shown.

As a result, the region remaining outside actual glove 5 or 50 of the rectangular sections, as viewed from the top, to be separated along perforation 18 is stable and does not interfere with the use of glove 5 or 50.

In a third embodiment of glove 5 (see FIG. 6: top view; see FIG. 7: view along line VII—VII in FIG. 6), plastic sheets 6, 7 are joined by sealing permanently and in an essentially fluid-impermeable manner not only along the lateral border regions but also in the border regions adjacent to glove opening 11.

Since the absorbent outer layer 12 applied to the top of inner face 10 has now been sprayed with a washing fluid, glove opening 11 is essentially sealed against the penetration of fluid and is designed to be opened when glove 5 is to be used.

Figure 7:
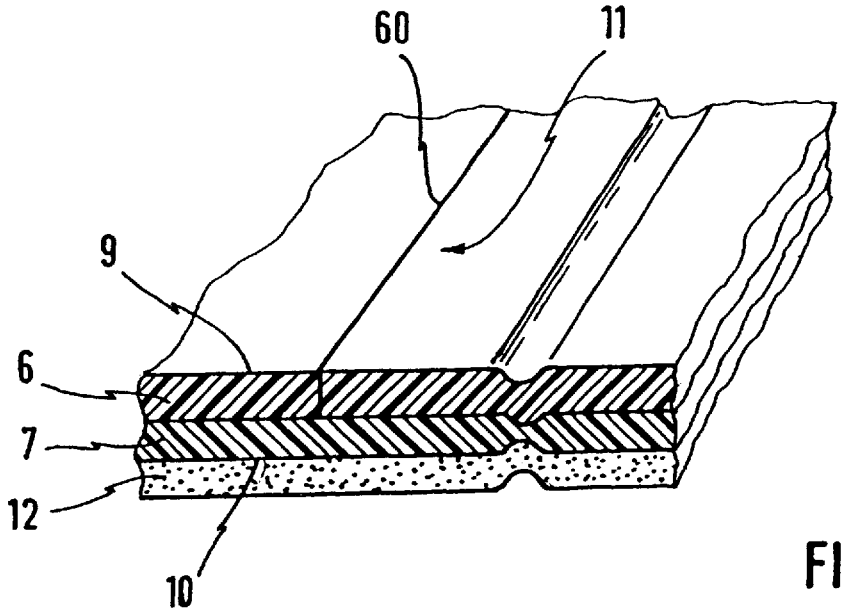
FIG. 7 shows a view along line VII—VII in FIG. 6.

In order now to provide access to the interior of glove 5 when the glove is to be used, there is provided in the region of glove opening 11 a tear line 60 on plastic sheet 6 containing outer face 9, which tear line extends perpendicularly to the hand-insertion direction and which is created before plastic sheet 6, plastic sheet 7 and outer layer 12 are joined by sealing (see FIG. 7).

This tear line 60 is closer to finger section 30 than the permanent and essentially fluid-impermeable joint of plastic sheets 6, 7 located in the border regions of glove opening 11 (see FIG. 6), glove opening 11 being designed to be opened along tear line 60. By opening this tear line 60, the hand may thus be inserted in the direction of insertion into the interior of glove 5.

Figure 6:
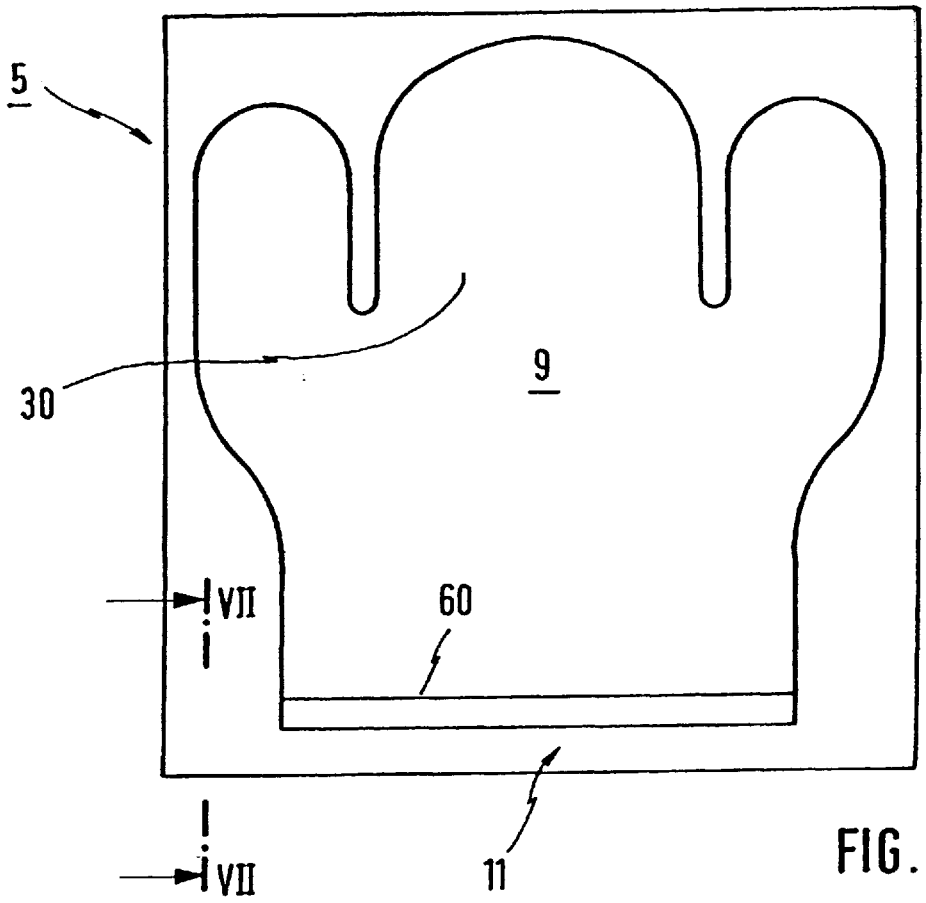
FIG. 6 shows a top view of a third embodiment of a glove according to the present invention.

As FIG. 6 also shows, tear line 60 extends across the width of glove 5 defined by the sealing seam to provide, as much as possible, complete access to the interior of glove 5. To ensure ease of manipulation, a linear shape has been selected for tear line 60.

In a fourth embodiment of glove 5 (see FIG. 8: top view, see FIG. 9: view along line IX—IX in FIG. 8), plastic sheets 6, 7 are joined by sealing permanently and in an essentially fluid-impermeable manner not only along the lateral border regions but also in the border regions of glove opening 11.

Since the absorbent outer layer 12 applied to the top of inner face 10 has now been sprayed with a washing fluid, glove opening 11 is essentially sealed against the penetration of fluid and is designed to be opened when glove 5 is to be used.

Figure 9:
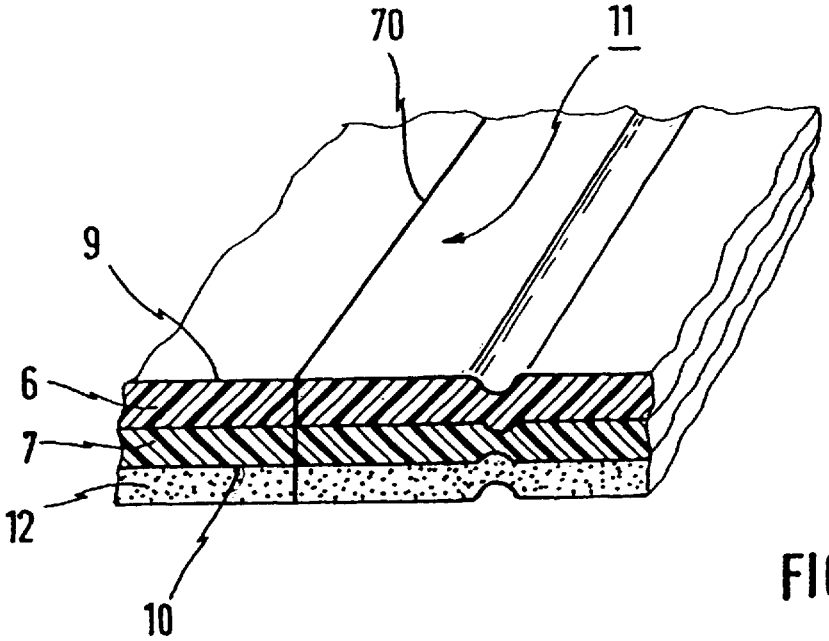
FIG. 9 shows a view along line IX—IX in FIG. 8.
Figure 10:
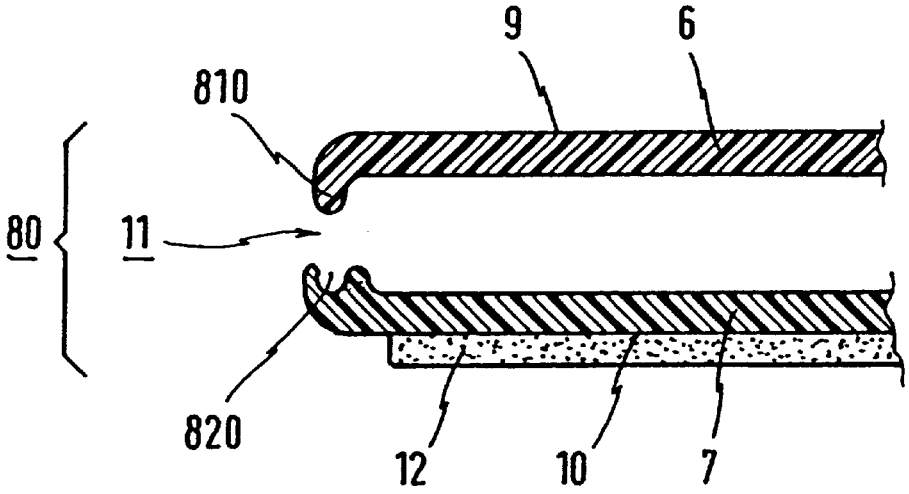
FIG. 10 shows a lateral sectional view of a fifth embodiment of a glove according to the present invention.
Figure 11:
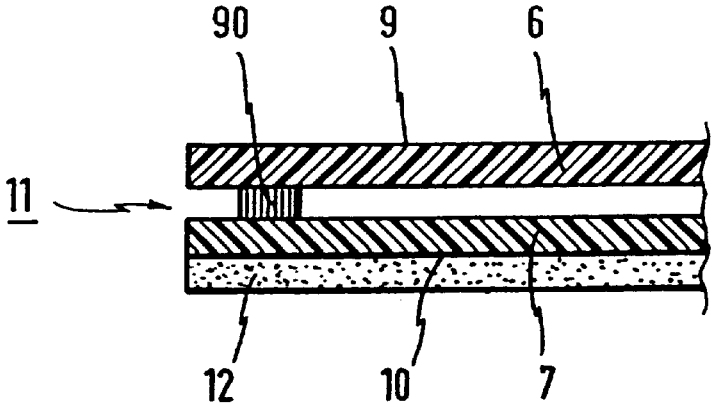
FIG. 11 shows a lateral sectional view of a sixth embodiment of a glove according to the present invention.

In order to provide access to the interior of glove 5 when the glove is to be used, there is provided in the region of glove opening 11 a tear line 70 on plastic sheet 6 containing outer face 9, on plastic sheet 7 containing inner face 10, and on outer layer 12, which tear line extends perpendicularly to the hand-insertion direction and which is created by knurling (see FIG. 9).

This tear line 70 is closer to finger section 30 than the permanent and essentially fluid-impermeable joint of plastic sheets 6, 7 located in the border regions of glove opening 11 (see FIG. 8), glove opening 11 being designed to be opened along tear line 70.

By providing this essentially "penetrating" tear line 70, that is one congruently comprising all layers (=plastic sheet 6, plastic sheet 7 and outer layer 12) of glove 5 (see FIG. 9), when glove 5 is to be used, access to glove opening 11 may be readily accomplished by detaching the section of glove 5 belonging to glove opening 11 along tear line 70.

Figure 8:
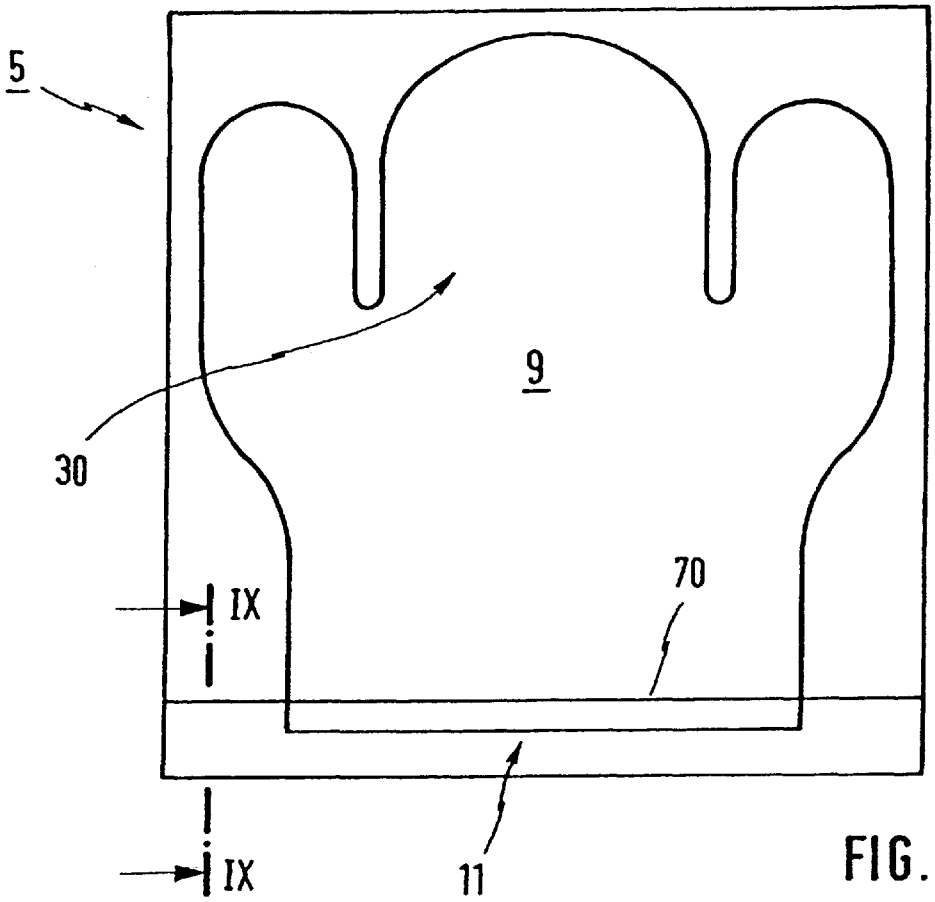
FIG. 8 shows a top view of a fourth embodiment of a glove according to the present invention.

As FIG. 8 also shows, tear line 70 extends across the entire width of glove 5 permitting complete access to the interior of glove 5 and the detachment of the section of glove 5 along tear line 70 belonging to glove opening 11. To ensure ease of manipulation, a linear shape has been selected for tear line 70.

In a fifth embodiment of glove 5 (see FIG. 10: lateral sectional view), a reclosable closure 80 is located along glove opening 11, the closure extending perpendicularly to the hand-insertion direction and across the entire width of glove opening 11.

This closure 80 consists of plastic—as are plastic sheets 6, 7—in the form of a so-called "mini-grip" system in which closure 80 has a strip 810 on the inner face of the one plastic sheet 6, and a grooved receiving means 820 for strip 810 on the inner face of the other plastic sheet 7 and belonging to strip 810. This closure 80 in the form of a so-called "mini-grip" system is easily capable of undergoing repeated use.

In a sixth embodiment of glove 5 (see FIG. 11: lateral sectional view), there is provided in the region of glove opening 11, between plastic sheet 6 containing inner face 9 and plastic sheet 7 containing inner face 10, an adhesive agent 90 in the form of an adhesive extending essentially perpendicularly to the hand-insertion direction, which adhesive extends essentially across the entire width of glove 5 and also functions as a closing means.

In order to save space, and thus packaging material and storage space, the gloves 5 are stored in a folded, rolled and/or stacked state, as is the case in the sixth embodiment (see FIG. 11)—and also in the previously described five embodiments in FIGS. 1 through 10.

Adhesive agent 90 reliably prevents any fluid with which outer layer 12 of glove 5 is impregnated from penetrating over time into the interior of glove 5 through glove opening 11, an undesirable result particularly for health reasons.

What is claimed is:

1. Glove, especially a single-use or disposable glove (5, 50), with at least two essentially congruent plastic sheets (6, 7), one forming the outer face (9) belonging to the back of the hand and one forming the inner face (10) belonging to the palm of the hand and with at least one absorbent outer layer (12) applied to the outer face (9) and/or top of the inner face (10), provided with at least one fluid, and specifically sprayed and/or soaked and/or impregnated, in which the plastic sheets (6, 7) are permanently joined to each other at least along the lateral border regions while providing a glove opening (11): which is opposite the finger section (30), which is essentially sealed against the penetration of fluid, and which may be exposed and/or opened when the glove is to be used.

2. Glove according to claim 1, characterized in that at least one strip (40) is located along the glove opening (11) or in the region of the glove opening (11) extending essentially perpendicularly to the hand-insertion direction.

3. Glove according to claim 2, characterized in that the strip (40) is attached to the edge (16) of the inner face (10) opposite the finger section (30).

4. Glove according to claim 2, characterized in that the strip (40) extends across essentially the entire width of the glove (5, 50).

5. Glove according to claim 1, characterized in that the plastic sheets (6, 7) are also joined permanently and in an essentially fluid-impermeable manner in the border regions of the glove opening (11).

6. Glove according to claim 1, characterized in that the edge (15) of the outer face (9) opposite the finger section (30) is offset from the edge (16) of the inner face (10) opposite the finger section (30).

7. Glove according to claim 1, characterized in that at least one closure (80) is located along the glove opening (11) or in the region of the glove opening (11).

8. Glove according to claim 7, characterized in that the closure (80) is removable for the purpose of exposing and/or opening the glove opening (11).

9. Glove according to claim 7, characterized in that the closure (80) extends essentially perpendicularly to the hand-insertion direction.

10. Glove according to claim 7, characterized in that the closure (11) extends essentially across the entire width of the glove opening (11).

11. Glove according to claim 7, characterized in that the closure (80) is designed to be reclosable.

12. Glove according to claim 7, characterized in that the closure (80) is made of plastic.

13. Glove according to claim 7, characterized in that the closure (80) has at least one strip (810) on the inner face of the one plastic sheet (6 or 7) and at least one grooved receiving means (820) for the strip (810) on the inner face of the other plastic sheet (7 or 6).

14. Glove according to claim 7, characterized in that the closure (80) is designed as at least one adhesive tape and/or as at least one adhesive label and/or at least one adhesive flap and/or at least one tape.

15. Glove according to claim 1, characterized in that there is provided in the region of the glove opening (11) between the plastic sheet (6) containing the outer face (9) and the plastic sheet (7) containing the inner face (10) at least one adhesive agent (90) extending in a direction essentially perpendicular to the hand-insertion direction.

16. Glove according to claim 15, characterized in that the adhesive agent (90) extends across essentially the entire width of the glove (5, 50).

17. Glove according to claim 15, characterized in that at least one adhesive is provided as the adhesive agent (90).

18. Glove according to claim 17, characterized in that the adhesive is at least one cold-setting adhesive or cold-setting glue and/or at least one thermosetting adhesive (so-called hot-melt adhesive).

19. Glove according to claim 1, characterized in that the outer layer (12) is applied only to the top of the inner face (10).

20. Glove according to claim 1, characterized in that the outer layer (12) is made of paper or a nonwoven material.

21. Glove according to claim 1, characterized in that the outer layer (12) is statically chargeable, especially electrostatically chargeable and/or magnetostatically chargeable.

22. Glove according to claim 21, characterized in that the outer layer (12) contains iron filings in powder form.

23. Glove according to claim 1, characterized in that the outer layer (12) contains at least one disinfecting and/or germicidal additive.

24. Glove according to claim 1, characterized in that the plastic sheets (6, 7) are joined to each other by adhesive bonding and/or by welding and/or by sealing.

25. Glove according to claim 24, characterized in that the plastic sheets (6, 7) are joined to each other along the lateral border regions (8).

26. Glove according to claim 1, characterized in that at least one of the plastic sheets (6, 7) is composed of polyethylene (PE) and/or polypropylene (PP) and/or copolymers.

27. Glove according to claim 1, characterized in that at least one of the plastic sheets (6, 7) is microperforated at least in certain regions.

28. Glove according to claim 1, characterized in that the plastic sheets (6, 7) are, as viewed from the top, of an essentially rectangular, or essentially round or rounded design.

29. Glove according to claim 1, characterized in that the plastic sheets (6, 7) have, at least in certain sections, at least one welding seam or sealing seam (17) running a certain distance from the lateral border regions (8) and/or from the folding edge (14) and forming an actual glove or a mitt.

30. Glove according to claim 29, characterized in that the welding seam or sealing seam (17) has on both sides of the finger section, as viewed from the top, one thumb section (51) each to accommodate a thumb.

31. Glove according to claim 1, characterized in that at least one additional congruent plastic sheet (20) is added to plastic sheets (6, 7) on the side opposite the outer layer (12) and that this additional plastic sheet (20) is joined at least to the adjacent plastic sheet (6) by an additional welding seam or sealing seam (21) which runs a certain distance from the welding seam or sealing seam (17).

32. Glove according to claim 31, characterized in that the additional welding seam or sealing seam (21) occupies or encloses an area larger than the welding seam or sealing seam (17).

33. Glove according to claim 1, characterized in that the glove (5, 50) has in the region of the glove opening (11) at least one locking closure with at least one fixation strip or closure strip (19) extending essentially perpendicularly to the hand-insertion direction.

34. Glove according to claim 33, characterized in that the fixation strip or closure strip (19) has two ends (19*a*, 19*b*).

35. Glove according to claim 34, characterized in that the one end (19*a*) is provided on the one side of the glove opening (11) and the other end (19*b*) is provided on the other side of the glove opening (11).

36. Glove according to claim 34, characterized in that the one end (19*a*) is foldable against the other end (19*b*) and the ends (19*a*, 19*b*) are detachably fastenable to each other.

37. Glove according to claim 34, characterized in that the one end (19*a*) is designed as at least one receiving component having a clear opening region and the other end (19*b*) is designed as an insertion component matched to the opening region for insertion into the opening region.

38. Glove according to claim 33, characterized in that the fixation or closure strip (19) is knottable and/or tieable and/or detachably fastenable by means of an adhesive or by means of at least one adhesive spot or by means of at least one adhesive strip or by means of at least one tape.

39. Glove according to claim 1, characterized in that at least one support strip (23) is provided on the outer face (9).

40. Glove according to claim 39, characterized in that two roughly parallel support strips (23*a*, 23*b*) are provided.

41. Glove according to claim 39, characterized in that the support strip (23) is provided to replace the plastic sheet (6) forming the outer face (9).

42. Glove according to claim 33, characterized in that at least one closure (80) is located along the glove opening (11) or in the region of the glove opening (11) and the closure (80) and the locking closure are designed to be uniform and/or of one piece and/or of integrated form.

* * * * *